US009585477B2

(12) United States Patent
Huang et al.

(10) Patent No.: US 9,585,477 B2
(45) Date of Patent: Mar. 7, 2017

(54) MOVABLE BACKREST OF AN ADJUSTABLE CHAIR

(71) Applicant: REMACRO Machinery & Technology (Wujiang) Co., Ltd., Suzhou (CN)

(72) Inventors: Bruce Huang, Suzhou (CN); James Li, Suzhou (CN); Dick Qin, Suzhou (CN); Daniel Wang, Suzhou (CN); Jerry Zou, Suzhou (CN)

(73) Assignee: REMACRO MACHINERY & TECHNOLOGY (WUJIANG) CO., LTD., Suzhou (CN)

( * ) Notice: Subject to any disclaimer, the term of this patent is extended or adjusted under 35 U.S.C. 154(b) by 165 days.

(21) Appl. No.: 14/352,757

(22) PCT Filed: Dec. 28, 2012

(86) PCT No.: PCT/CN2012/087912

§ 371 (c)(1),
(2) Date: Apr. 18, 2014

(87) PCT Pub. No.: WO2014/067217

PCT Pub. Date: May 8, 2014

(65) Prior Publication Data

US 2015/0108812 A1 Apr. 23, 2015

(30) Foreign Application Priority Data

Nov. 1, 2012 (CN) ..... 2012 1 0429985

(51) Int. Cl.
*A47C 1/024* (2006.01)
*A47C 1/0355* (2013.01)
(Continued)

(52) U.S. Cl.
CPC ..... *A47C 1/024* (2013.01); *A47C 1/0342* (2013.01); *A47C 1/0355* (2013.01); *A47C 3/00* (2013.01)

(58) Field of Classification Search
None
See application file for complete search history.

(56) References Cited

U.S. PATENT DOCUMENTS 4,131,960 A * 1/1979 Quakenbush ..... A47C 17/1756 297/342
4,815,788 A * 3/1989 May ..... A47C 1/0355 297/318

(Continued)

FOREIGN PATENT DOCUMENTS

CN 2128078 3/1993
CN 2192218 3/1995

(Continued)

*Primary Examiner* — David E Allred
(74) *Attorney, Agent, or Firm* — Hamre, Schumann, Mueller & Larson, P.C.

(57) ABSTRACT

The invention is directed to a movable backrest of an adjustable chair, which can include: a backrest assembly, a first backrest support, a first backrest connector, a second backrest support, a second backrest connector, and a backrest guiding apparatus; the backrest assembly is connected to the first backrest support through a first shaft, the backrest assembly is connected to the guiding apparatus through a seventh shaft, the first backrest support is connected to the first backrest connector through a second shaft, the backrest guiding apparatus is connected to the first backrest connector through a sixth shaft. The invention is simple, durable, and easy to operate, can help eliminate a gap between the backrest and the sitting pad when the adjustable chair is at different positions, reduce the friction feeling of a person's back and prevent the backrest from touching the well when the adjustable chair is at different positions.

5 Claims, 4 Drawing Sheets

(51) Int. Cl.
*A47C 1/034* (2006.01)
*A47C 3/00* (2006.01)

(56) References Cited

U.S. PATENT DOCUMENTS

| | | | | | |
|---|---|---|---|---|---|
| 4,904,019 | A * | 2/1990 | May | A47C 1/0352 | 297/68 |
| 5,072,988 | A * | 12/1991 | Plunk | A47C 1/0355 | 297/68 |
| 5,340,191 | A * | 8/1994 | May | A47C 1/0355 | 297/403 |
| 5,772,278 | A * | 6/1998 | Kowalski | A47C 1/0355 | 297/85 L |
| 2004/0051350 | A1* | 3/2004 | Duncan | A47C 1/0352 | 297/68 |
| 2014/0265497 | A1* | 9/2014 | Hough | A61G 5/14 | 297/316 |
| 2014/0327282 | A1* | 11/2014 | Crum | A47C 1/032 | 297/259.2 |

FOREIGN PATENT DOCUMENTS

| | | |
|---|---|---|
| CN | 200941924 | 9/2007 |
| CN | 101099619 | 1/2008 |
| DE | 2801307 | 7/1979 |
| EP | 1066776 | 1/2001 |

* cited by examiner

MOVABLE BACKREST OF AN ADJUSTABLE CHAIR

TECHNOLOGY FIELD

The invention in this disclosure relates to a sofa chair. More particularly, this disclosure relates to an adjustable sofa with a movable backrest that is movable along with a movement of a person's back, which can eliminate a gap between the backrest and a sitting pad when the adjustable chair is at different positions. The movable backrest can also help achieve zero spacing with a wall during folding-unfolding of the adjustable chair.

BACKGROUND

Referring to FIG. 5, presently a conventional adjustable sofa chair may not be able to adjust to different positions when the sofa chair is positioned against a wall. That is, when a footrest extends forwardly while a backrest of the adjustable sofa chair is positioned against a wall, the backrest of the adjustable sofa chair may only move forwardly limitedly. And then when the backrest moves downwardly, the backrest moves downwardly and backwardly at the same time, which can cause the backrest to touch the wall before the backrest reaches its final position. Therefore, the adjustable sofa chair cannot be positioned against the wall completely, reducing space usage efficiency. The backrest of a conventional adjustable sofa chair may also not be able to move along with a person's back. When a person is in a sitting position, the person's back is at a sitting back position K, the person's head is at a sitting head position L. When the person is in a lying position, because the position of the chair does not change, the person's back is at a lying back position K' and the person's head is at a lying heat position L'. There is a position shift U, which may cause discomfort.

SUMMARY

The invention as disclosed herein is intended to solve above-mentioned technical issues related to the conventional design, and provides a movable backrest with a simple structure, which can achieve zero spacing with a wall, eliminate a gap between the backrest and a sitting pad when the adjustable chair is at different positions, and have a backrest that moves along with a person's back.

The technical solutions for the invention to solve above-mentioned technical issues include: the movable backrest of an adjustable chair including: a backrest assembly, a first backrest support, a first backrest connector, a second backrest support, a second backrest connector, and a backrest guiding apparatus; the backrest assembly is connected to the first backrest support through a first shaft, the backrest assembly is connected to the backrest guiding apparatus through a seventh shaft, the first backrest support is connected to the first backrest connector through a second shaft, the backrest guiding apparatus is connected to the first backrest connector through a sixth shaft, the second backrest support is connected to the first backrest connector through a third shaft, the second backrest connector is connected to the backrest guiding apparatus through a fifth shaft, the second backrest support is configured to form cross with the second backrest connector and are connected through a fourth shaft.

Centerlines of the first, second, sixth and seventh shafts in this invention are configured to form a parallelogram.

The backrest guiding apparatus includes a position-limiting rivet, which can be used for support and to set a limit when the adjustable sofa is lying down.

The invention has a simple structure, and is easy to use. The invention can achieve zero spacing with a wall, eliminate a gap between the backrest and a sitting pad when the adjustable chair is at different positions, and move the backrest along with a person's back so that the person's back may not fell a friction. These can help improve comfortableness of the adjustable chair.

DETAILED DESCRIPTION

The invention is further described with the accompanying drawings and exemplary embodiments.

Figure 1:
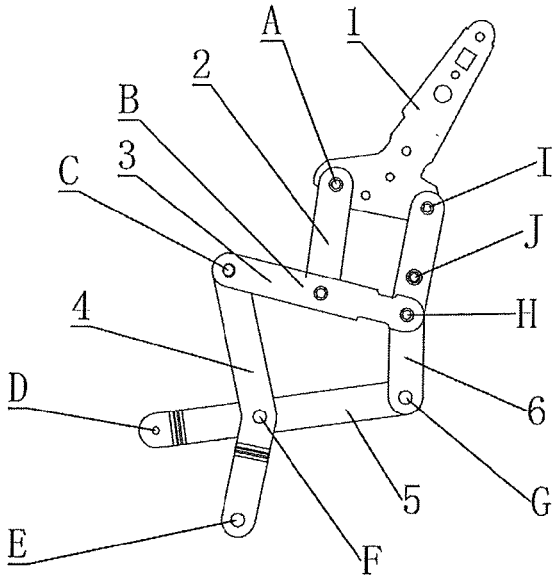
FIG. 1 is a side view of one embodiment of the invention.

The embodiment of a movable backrest of an adjustable chair include a backrest assembly 1, a first backrest support 2, a first backrest connector 3, a second backrest support 4, a second backrest connector 5, and a backrest guiding apparatus 6. The backrest assembly 1 is connected to the first backrest support 2 through a first shaft A, the backrest assembly 1 is connected to the backrest guiding apparatus 6 through a seventh shaft I, the first backrest support 2 is connected to the first backrest connector 3 through a second shaft B, the backrest guiding apparatus 6 is connected to the first backrest connector 3 through a sixth shaft H. Movements and swing angles of backrest assembly 1 can be controlled by the backrest assembly 1, the first backrest support 2, the first backrest connector 3 and the guiding backrest apparatus 6 through the first shaft A, the second shaft B, the sixth shaft H, the seventh shaft I, so that desired movements and lying angles of the backrest of the adjustable chair can be achieved. Centerlines of the first shaft A, the second shaft B, the sixth shaft B and the seventh shaft I respectively are configured to form a parallelogram ABHI, (see FIG. 1), which can help achieve a relatively easy adjustment and a relatively large adjustment range. The second backrest support 4 is connected to the first backrest connector 3 through a third shaft C, the second backrest connector 5 is connected to the backrest guiding apparatus 6 through a fifth shaft G, the second backrest support 4 and the second backrest connector 5 forms a cross and are connected through a fourth shaft F. A displacement caused by unfolding the adjustable chair can drive the second backrest support 4 and the second backrest connector 5 to open so as to drive the first backrest connector 3 and the backrest guiding apparatus 6 to open and result in a displacement. As a result, an upper portion of the backrest moves downwardly and a lower portion of the backrest move forwardly (the left side in the drawing is the forward direction), which can help eliminate a movement of the backrest relative to a person's back.

The embodiment also includes a position-limiting rivet J on the backrest guiding apparatus 6, which can be used to support and limit the position of the adjustable chair when the adjustable chair is lying down, increasing the stability of the backrest.

In the illustrated embodiment, the second backrest support 4 is connected to a driving device of the adjustable chair through a ninth shaft E, and the second backrest connector 5 is connected to the driving device of the adjustable chair through an eighth shaft D, which can be used to link a movement of a person's back to a movement of the driving device of the adjustable chair.

Figure 2:
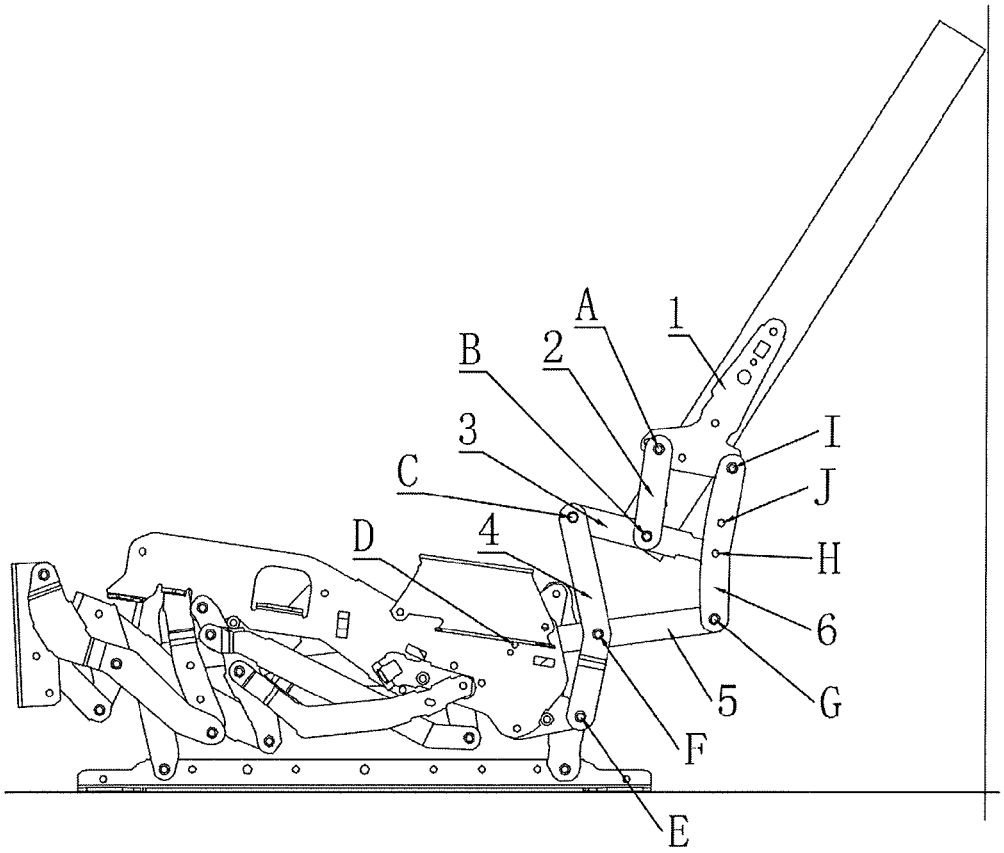
FIG. 2 is a side view of the embodiment in the first state, where a backrest assembly has the same angle as the original backrest.
Figure 3:
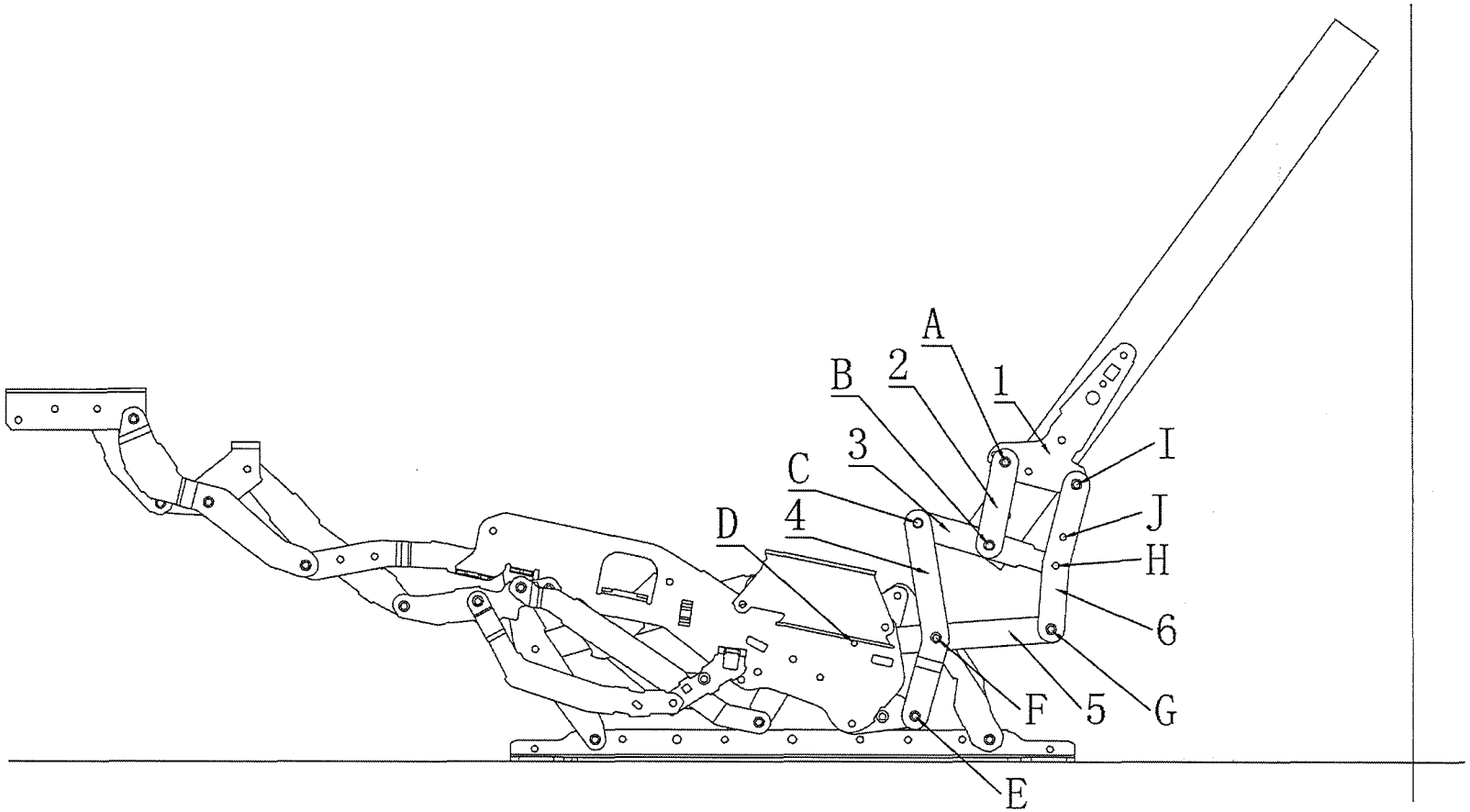
FIG. 3 is a side view of the embodiment in the second state, where a footrest is extended.
Figure 4:
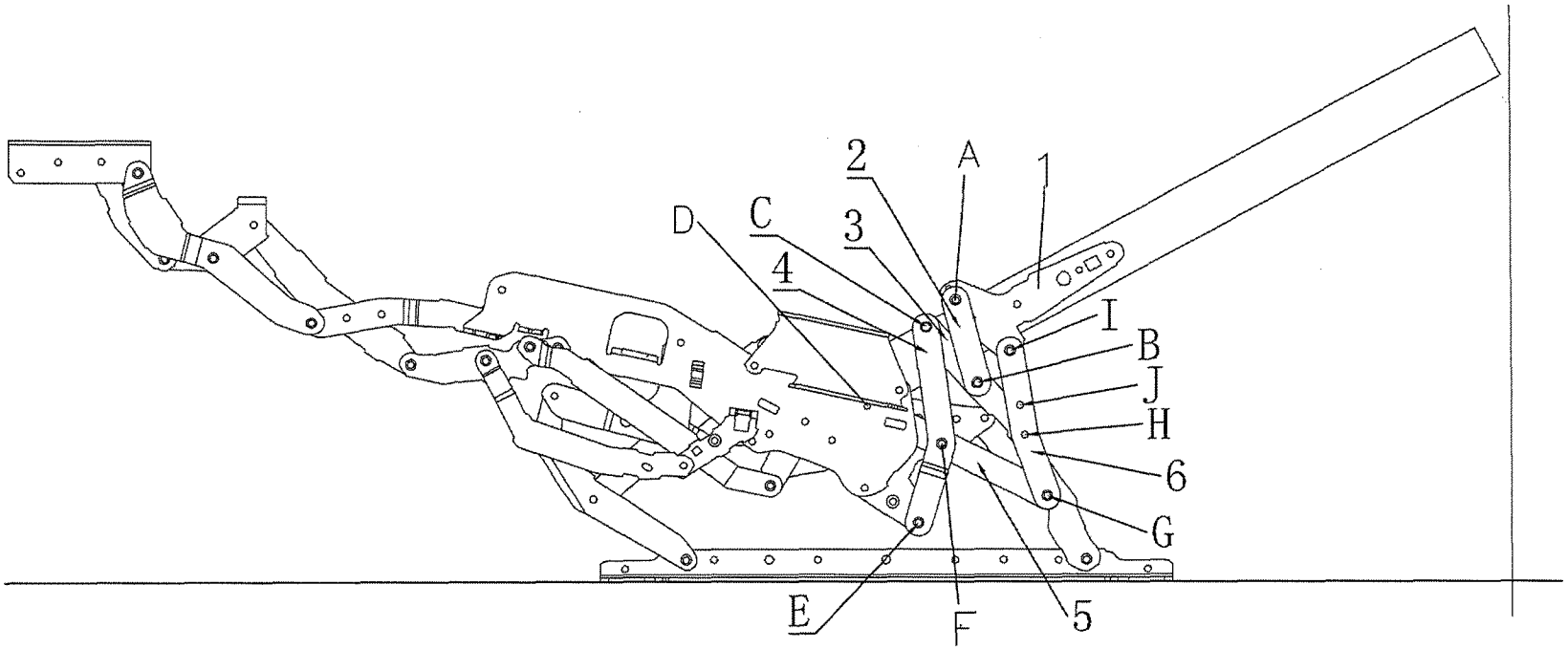
FIG. 4 is a side view of the embodiment in the third state, where the backrest has a space with a wall and has a similar angle as the original backrest.
Figure 5:
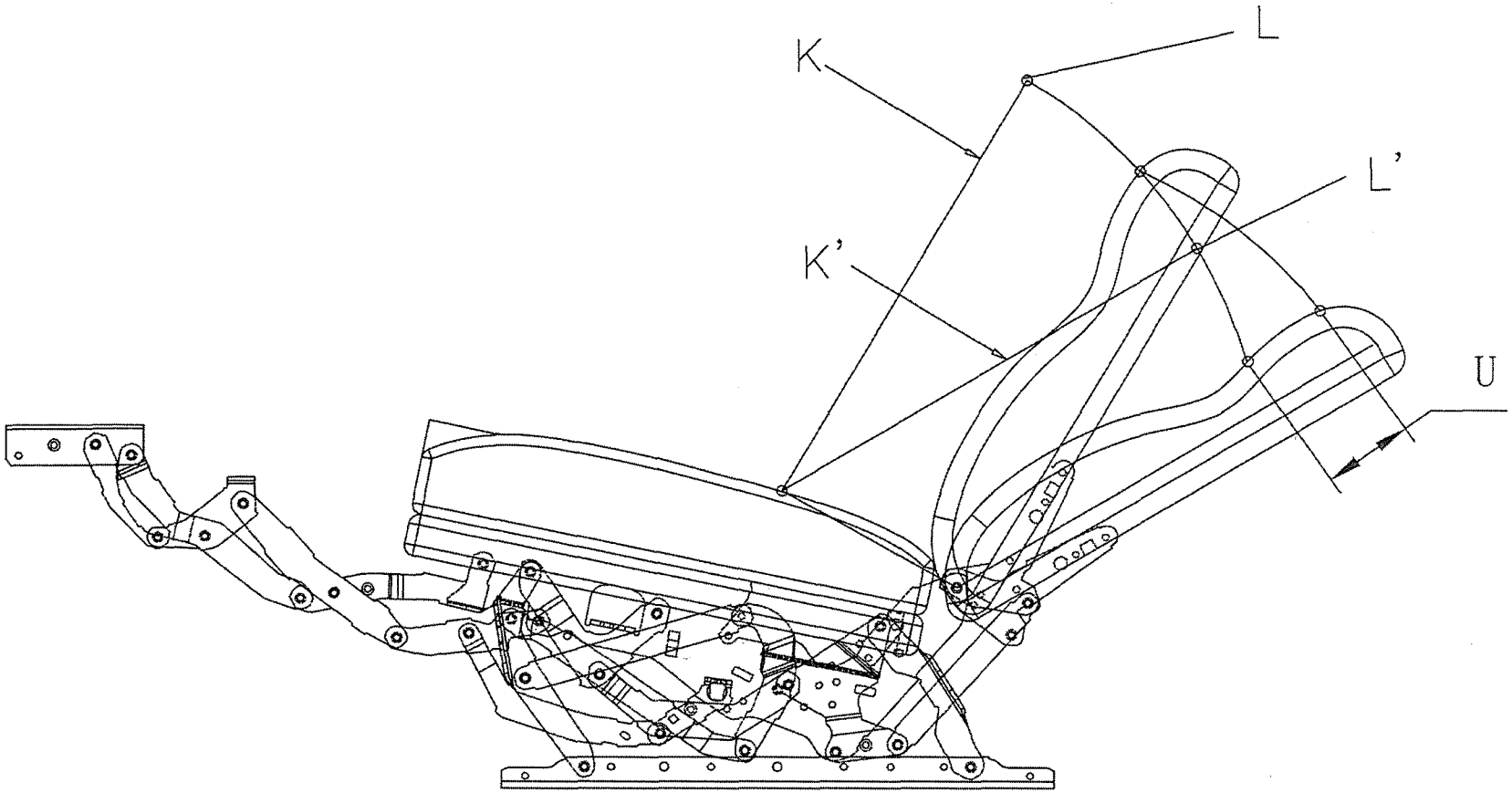
FIG. 5 illustrates a present sofa chair design and its position changes during usage.

When the backrest of the adjustable chair illustrated herein is in a sitting state (i.e. in the state as illustrated in FIG. 2), the driving device (which is similar to a conventional design) of the adjustable chair is in a folded position. As the adjustable chair unfolds, the driving device can have a displacement through the eighth shaft D and the ninth shaft E. Therefore, the backrest retains the original angle and moves synchronously with a footrest driving device (i.e. in the state as illustrated in FIG. 3). As the adjustable chair continues to unfold, the eighth shaft D and the ninth shaft E gradually opens, causing the shaft F to rotate and drive the third shaft C and the shaft G to open. Then, the sixth shaft H and the fourth shaft F move closer and drive the backrest connector 3 to rotate downwardly. The downwardly rotation of the backrest connector 3 can also drive the second shaft B so as to drive a downward movement of the first backrest support 2. At the same time, due to the movements of the sixth shaft H and the second shaft B, an angle between the first backrest connector 3 and the first backrest support 2, the backrest guiding apparatus 6 reduces, causing the seventh shaft I and the second shaft B to move closer. These movements cause the backrest to move forwardly. The backrest assembly 1, due to a relatively small displacement of the first shaft A on the first backrest support 2 and a relative large displacement of the seventh shaft on the backrest guiding apparatus, changes its angle. As a result, the backrest assembly 1 can gradually lean backwardly and reach the lying state (i.e. the state as illustrated in FIG. 4). When fully unfolded, the position-limiting rivet 6 on the guiding apparatus 6 can bear the first backrest support 3, increasing the stability of the backrest.

This invention can help eliminate a gap between the backrest and the sitting pad when the adjustable chair is at different positions, reduce friction feeling on a person's back and prevent the backrest from touching the well when the adjustable chair is at different positions. The invention is simple, durable, and easy to operate. The backrest can be driven by changing the states of the adjustable chair.

Any modification or equivalent substitution according to the present invention, should be considered to fall within the protection scope of the present invention.

The invention claimed is:

1. A movable backrest for an adjustable chair, comprising:
a backrest assembly;
a first backrest support;
a first backrest connector;
a second backrest support;
a second backrest connector; and
a backrest guiding apparatus;
wherein the backrest assembly is connected to the first backrest support through a first shaft, the backrest assembly is connected to the backrest guiding apparatus through a seventh shaft, the first backrest support is connected to the first backrest connector through a second shaft, the backrest guiding apparatus is connected to the first backrest connector through a sixth shaft, the second backrest support is connected to the first backrest connector through a third shaft, the second backrest connector is connected to the backrest guiding apparatus through a fifth shaft, and the second backrest support through a connection with a fourth shaft forms a cross with the second backrest connector,
wherein the third shaft is disposed at a first end of the first backrest connector, the sixth shaft is disposed at a second end of the first backrest connector, the second end being opposite the first end, and the second shaft is disposed between the third shaft and the sixth shaft.

2. The moveable backrest of claim 1, wherein centerlines of the first shaft, the second shaft, the sixth shaft, and the seventh shaft form a parallelogram.

3. The moveable backrest of claim 1, wherein the backrest guiding apparatus has a position-limiting rivet.

4. The moveable backrest of claim 2, wherein the backrest guiding apparatus has a position-limiting rivet.

5. An adjustable chair, comprising:
a sitting pad, a movable backrest, and an extendable footrest,
wherein the movable backrest includes:
a backrest assembly;
a first backrest support;
a first backrest connector;
a second backrest support;
a second backrest connector; and
a backrest guiding apparatus;
wherein the backrest assembly is connected to the first backrest support through a first shaft, the backrest assembly is connected to the guiding apparatus through a seventh shaft, the first backrest support is connected to the first backrest connector through a second shaft, the backrest guiding apparatus is connected to the first backrest connector through a sixth shaft, the second backrest support is connected to the first backrest connector through a third shaft, the second backrest connector is connected to the guiding apparatus of the backrest through a fifth shaft, and the second backrest support through a connection with a fourth shaft forms a cross with the second backrest connector,
wherein the third shaft is disposed at a first end of the first backrest connector, the sixth shaft is disposed at a second end of the first backrest connector, the second end being opposite the first end, and the second shaft is disposed between the third shaft and the sixth shaft.

* * * * *